US007239686B2

(12) United States Patent
Berglund et al.

(10) Patent No.: US 7,239,686 B2
(45) Date of Patent: Jul. 3, 2007

(54) METHOD AND ARRANGEMENT FOR PRODUCING RADIATION

(75) Inventors: Magnus Berglund, Axeltorp (SE); Björn Hansson, Stockholm (SE); Oscar Hemberg, Stockholm (SE); Hans Hertz, Stocksund (SE); Lars Rymell, Stockholm (SE)

(73) Assignee: Jettec AB, Stocksund (SE)

( * ) Notice: Subject to any disclaimer, the term of this patent is extended or adjusted under 35 U.S.C. 154(b) by 0 days.

(21) Appl. No.: 10/513,403

(22) PCT Filed: May 13, 2003

(86) PCT No.: PCT/EP03/04984

§ 371 (c)(1),
(2), (4) Date: Jan. 5, 2005

(87) PCT Pub. No.: WO03/096764

PCT Pub. Date: Nov. 20, 2003

(65) Prior Publication Data

US 2005/0129177 A1 Jun. 16, 2005

Related U.S. Application Data

(60) Provisional application No. 60/398,014, filed on Jul. 24, 2002.

(30) Foreign Application Priority Data

May 13, 2002 (EP) ..... 02076898

(51) Int. Cl.
*H05G 2/00* (2006.01)

(52) U.S. Cl. ..... 378/119; 250/504 R

(58) Field of Classification Search ..... 378/119, 378/143; 250/504 R
See application file for complete search history.

(56) References Cited

U.S. PATENT DOCUMENTS 4,723,262 A 2/1988 Noda et al.

(Continued)

FOREIGN PATENT DOCUMENTS

WO WO 02/32197 4/2002

OTHER PUBLICATIONS

Rymell and Hertz, "*Droplet Target for Low-Debris Laser-Plasma Soft X-Ray Generation*", Optics Communications 103 (1993), pp. 105 to 110.

(Continued)

*Primary Examiner*—Edward J. Glick
*Assistant Examiner*—Chih-Cheng Glen Kao
(74) *Attorney, Agent, or Firm*—Buchanan Ingersoll & Rooney PC

(57) ABSTRACT

A method of producing a radiating plasma with an increased flux stability and uniformity is disclosed. The method comprises the steps of generating a primary target by urging a liquid under pressure through a nozzle; directing an energy pre-pulse onto the primary target to generate a secondary target in the form of a gas or plasma cloud; allowing the thus formed secondary target to expand for a predetermined period of time; and directing a main energy pulse onto the secondary target when the predetermined period of time has elapsed in order to produce a plasma radiating X-ray or EUV radiation. The pre-pulse has a beam waist size that is larger, in at least one dimension, than the corresponding dimension of the primary target.

20 Claims, 5 Drawing Sheets

U.S. PATENT DOCUMENTS

| | | | | |
|---|---|---|---|---|
| 5,003,543 | A | 3/1991 | Morsell et al. | |
| 5,089,711 | A | 2/1992 | Morsell et al. | |
| 5,175,757 | A | 12/1992 | Augustoni et al. | |
| 5,606,588 | A * | 2/1997 | Umstadter et al. | 378/119 |
| 5,637,962 | A * | 6/1997 | Prono et al. | 315/111.21 |
| 5,991,360 | A * | 11/1999 | Matsui et al. | 378/119 |
| 6,002,744 | A * | 12/1999 | Hertz et al. | 378/119 |
| 6,324,256 | B1 * | 11/2001 | McGregor et al. | 378/119 |
| 2002/0141537 | A1 * | 10/2002 | Mochizuki | 378/119 |

OTHER PUBLICATIONS

Foster et al., "*Apparatus for Producing Uniform Solid Spheres of Hydrogen*", Rev. Sci. Instrum., vol. 48, No. 6, (1977), pp. 625 to 631.

Berglund et al., "*Cryogenic Liquid-Jet Target for Debris-Free Laser-Plasma Soft X-Ray Generation*", Rev. Sci. Instrum., vol. 69, No. 6, (1998), pp. 2361 to 2364.

Rymell et al., "*Liquid-Jet Target Laser-Plasma Sources for EUV and X-Ray Lithography*", Microelectronic Engineering 46 (1999), pp. 453 to 455.

Berglund et al., "*Ultraviolet Prepulse for Enhanced X-Ray Emission and Brightness from Droplet-Target Laser Plasmas*", Appl. Phys. Lett. 69 (12), 1996, pp. 1683 to 1685.

Magnus Berglund et al., "*Ultraviolet Prepulse for Enhanced X-Ray Emission and Brightness from Droplet-Target Laser Plasmas*", Applied Physics Letters, American Institute of Physics, New York, U.S., vol. 69, No. 12, Sep. 16, 1996, pp. 1683-1685.

* cited by examiner

METHOD AND ARRANGEMENT FOR PRODUCING RADIATION

This is a national phase filing under 35 U.S.C. § 371 of International Application No. PCT/EP03/04984, filed May 13, 2003, that designates the United States of America. The benefit is claimed under 35 U.S.C. § 119(a)–(d) of Swedish Application No. 02076898.2, filed May 13, 2002, and under 35 U.S.C. § 119(e) of U.S. Provisional Application No. 60/398,014, filed Jul. 24, 2002.

TECHNICAL FIELD

The present invention relates to a method for producing X-ray or extreme ultraviolet (EUV) radiation. In particular, the present invention relates to improvements in flux stability and uniformity in connection with energy beam produced plasmas.

BACKGROUND OF THE INVENTION

EUV and X-ray sources of high intensity are applied in many fields, for instance surface physics, materials testing, crystal analysis, atomic physics, medical diagnostics, lithography and microscopy. Conventional X-ray sources, in which an electron beam is brought to impinge on an anode, generate a relatively low X-ray intensity. Large facilities, such as synchrotron light sources, produce a high average power. However, there are many applications that require compact, small-scale systems which produce a relatively high average power. Compact and more inexpensive systems yield better accessibility to the applied user and are thus of potentially greater value to science and society. An example of an application of particular industrial importance is future narrow-line-width lithography systems.

Ever since the 1960s, the size of the structures that constitute the basis of integrated electronic circuits has decreased continuously. The advantage thereof is faster and more complicated circuits needing less power. Typically, photolithography is used to industrially produce such circuits having a line width of about 0.18 μm with projected extension towards 0.065 μm. In order to further reduce the line width, other methods will probably be necessary, of which EUV projection lithography is a prime candidate and X-ray lithography may become interesting for some technological niches. In EUV projection lithography, use is made of a reducing extreme ultraviolet (EUV) objective system in the wavelength range around 10–20 nm. Proximity X-ray lithography, employing a contact copy scheme, is carried out in the wavelength range around 1 nm.

Laser produced plasmas are attractive table-top X-ray and EUV sources due to their high brightness, high spatial stability and, potentially, high-repetition rate. However, with conventional bulk or tape targets, the operating time is limited, especially when high-repetition-rate lasers are used, since fresh target material cannot be supplied at a sufficient rate. Furthermore, such conventional targets produce debris which may destroy or coat sensitive components such as X-ray optics or EUV multi-layer mirrors positioned close to the plasma. Several methods have been designed to eliminate the effect of debris by preventing the already produced debris from reaching the sensitive components. As an alternative, the amount of debris actually produced can be limited by replacing conventional solid targets by for example gas targets, gas-cluster targets, liquid-droplet targets, or liquid-jet targets.

Targets in the form of microscopic liquid droplets, such as disclosed in the article "Droplet target for low-debris laser-plasma soft X-ray generation" by Rymell and Hertz, published in Opt. Commun. 103, p. 105, 1993, are attractive low-debris, high-density targets potentially capable of high repetition-rate laser-plasma operation with high-brightness emission. Such droplets are generated by stimulated breakup of a liquid jet which is formed at a nozzle in a low-pressure chamber. However, the hydrodynamic properties of some fluids result in unstable drop formation. Furthermore, the operation of the laser must be carefully synchronized with the droplet formation. Another problem may arise in the use of liquid substances with rapid evaporation, namely that the jet freezes immediately upon generation so that drops cannot be formed. Such substances primarily include media that are in a gaseous state at normal pressure and temperature and that are cooled to a liquid state for generation of the droplet targets. To ensure droplet formation, it is necessary to provide a suitable gas atmosphere in the low-pressure chamber, or to raise the temperature of the jet above its freezing temperature by means of an electric heater provided around the jet, such as disclosed in the article "Apparatus for producing uniform solid spheres of hydrogen" by Foster et al., published in Rev. Sci. Instrum. 6, pp 625–631, 1977.

As an alternative, as known from U.S. Pat. No. 6,002,744, which is incorporated herein by reference, the laser radiation is instead focused on a spatially continuous portion of a jet which is generated by urging a liquid substance through an outlet or nozzle. This liquid-jet approach alleviates the need for temporal synchronization of the laser with the generation of the target, while keeping the production of debris equally low as from droplet targets. Furthermore, liquid substances having unsuitable hydrodynamic properties for droplet formation can be used in this approach. Another advantage over the droplet-target approach is that the spatially continuous portion of the jet can be allowed to freeze. Such a liquid-jet laser-plasma source has been further demonstrated in the article "Cryogenic liquid-jet target for debris-free laser-plasma soft x-ray generation" by Berglund et al, published in Rev. Sci. Instrum. 69, p. 2361, 1998, and the article "Liquid-jet target laser-plasma sources for EUV and X-ray lithography" by Rymell et al, published in Microelectronic Engineering 46, p. 453, 1999, by using liquid nitrogen and xenon, respectively, as target material. In these cases, a high-density target is formed as a spatially continuous portion of the jet, wherein the spatially continuous portion can be in a liquid or a frozen state. Such laser-plasma sources have the advantage of being high-brightness, low-debris sources capable of continuous high-repetition-rate operation, and the plasma can be produced far from the outlet nozzle, thereby limiting thermal load and plasma-induced erosion of the outlet nozzle. Such erosion may be a source of damaging debris. Further, by producing the plasma far from the nozzle, self-absorption of the generated radiation can be minimized. This is due to the fact that the temperature of the jet (or train of droplets) decreases with the distance from the outlet, resulting in a correspondingly decreasing evaporation rate. Thus, the local gas atmosphere around the jet (or train of droplets) also decreases with the distance from the outlet.

However, many substances, and in particular liquid substances formed by cooling normally gaseous substances, gives a jet or a train of droplets that experiences stochastic changes in its direction from the jet-generating nozzle. Typically the change in direction can be as large as about ±1° and occurs a few times per minute to a few times per second. This comparatively coarse type of directional instability can be eliminated by means of, for example, the method disclosed in Swedish patent application No. SE 0003715-0. However, for some applications, an extremely high flux stability and uniformity is required. One example of an application where a very high degree of flux stability and uniformity is required is in EUV lithography. In particular, this high degree of stability is required in so-called steppers and in metrology and inspection apparatuses. Even though the method as disclosed in the above-mentioned Swedish application is employed, there are still some micro-fluctuations left in the position of the target. This in turn results in a spatial instability at the focus of the laser beam, i.e. at the desired area of beam-target-interaction, which should be as far away from the outlet nozzle as possible for the reasons given above. The spatial instability leads to pulse-to-pulse fluctuations in the emitted X-ray and EUV radiation flux and spatial instability of the radiating plasma.

SUMMARY OF THE INVENTION

Therefore, it is an object of the present invention to provide an improved method for producing X-ray or EUV radiation by energy beam produced plasma emission, wherein the detrimental effects of these positional fluctuations in the target are eliminated, or at least considerably reduced.

In general, it is an object of the present invention to improve pulse-to-pulse and long-term stability of position, flux and spatial distribution of the emitted radiation from a plasma produced by directing an energy pulse such as a laser pulse onto a target.

The invention is based upon a new way of employing "pre-pulses" for plasma production. A pre-pulse is an energy pulse that precedes the main plasma-producing pulse. Pre-pulses have previously been utilized in order to enhance the total X-ray emission from a laser produced plasma. See for example "Ultraviolet prepulse for enhanced x-ray emission and brightness from droplet-target laser plasmas", by M. Berglund et al., Applied Physics Letters, Vol. 69, No. 12 (1996), pages 1683–1685. Berglund et al. identifies small variations in droplet position with respect to the laser-beam focus as a cause of fluctuations in the X-ray flux. However, no solution to the said problem is suggested. Although energy pulses in the form of laser pulses are preferred, other types of energy pulses are also conceivable, such as electron beam pulses. However, in the following description, energy pulses in the form of laser pulses will be taken as the preferred example.

In general, it is desirable to produce the radiating plasma as far away from the nozzle as possible, in order to minimize the thermal load and erosion of the nozzle caused by the presence of the plasma. However, the further away from the nozzle the energy beam is directed onto the target, the more sensitive is the flux of the produced radiation to directional instabilities in the target relative to the energy beam. The reason for this has been identified as that the plasma-producing beam simply does not "hit" the target optimally, thus intermittently producing an unstable or weakly radiating plasma. Moreover, there are other reasons that the energy pulse might not hit the target optimally. For example, in the case when the target is a droplet or a train of droplets, there may be a variation in the time of arrival of the droplets to the area of interaction (the area where the energy pulse is directed onto the target). This leads to a positional uncertainty regarding the target position relative to the energy pulse, and hence to fluctuations in the produced radiation. Also, the target might in fact be a frozen jet that has broken up into fragments, causing a similar positional uncertainty. Regardless of the reason for the positional uncertainty of the target relative to the energy pulse, the present invention provides improvements of the pulse-to-pulse and long term stability of position, flux and spatial distribution of the emitted radiation.

Simply going to larger target jets is not a good solution due to vacuum problems. When using cryogenic targets (i.e. targets that freeze by evaporation in the vacuum chamber), evaporation of target material makes it hard to maintain a good vacuum. Therefore, it is preferred to use small target jets, where a higher propagation speed can be utilized without causing a too high evaporation (and hence deterioration of the vacuum). In addition, a high propagation speed for the target jet may improve the stability of the target.

According to the present invention, pre-pulses are used in order to form an expanding gas or plasma cloud (a secondary target), upon which a main energy pulse is directed in order to produce a plasma with a high degree of ionization that radiates the desired X-ray or EUV radiation. The pre-pulse is directed onto the target in a state where the target is said to be a primary target, while the main energy pulse is directed onto the gas or plasma cloud formed by the pre-pulse. In this application, the gas or plasma cloud formed by means of the pre-pulse is called a secondary target.

According to the present invention, an expanded pre-pulse is used that has a beam waist size that is larger than the dimension of the target in at least one dimension, in order to form a secondary target. In other words, the pre-pulse is given a beam waist that is larger than the target in the smallest dimension thereof. The expanded pre-pulse should have a size equal to or larger than the expected variation in target position (relative to the energy beam), in order to "hit" the target on every shot. In order to provide the above-mentioned stability with regard to pulse-to-pulse or long-term fluctuations in flux, position and distribution, the energy pre-pulse should provide a secondary target that can be hit in a similar way on every shot of a main plasma-producing energy pulse. The gas or plasma cloud produced by the pre-pulse is then allowed to expand for a predetermined period of time in order to form an expanded secondary target. Then, the main energy pulse is directed onto the secondary target to form a radiating plasma having a comparatively high degree of ionization. The beam waist size and shape of the main energy pulse is preferably adapted to the size and shape of the secondary target. By using a pre-pulse having a comparatively low energy, although having a beam waist size that is larger than the smallest dimension of the target, only a small amount of energy is wasted by the pre-pulse. At the same time, the pre-pulse produces a gas or plasma cloud that expands, forming a secondary target. Since the pre-pulse is larger than the primary target in the smallest dimension of the target, the influence from possible deviations in the position of the primary target on the secondary target is reduced. Then, supported by the fact that the main energy pulse is preferably adapted in size with the expanded plasma cloud (the secondary target), the influence of fluctuations in the position of the primary target on the total flux is drastically reduced. Micro-fluctuations in the relative position of the laser focus and the primary target gives only a small relative change in the overlap between the main energy pulse and the expanded secondary target cloud. Fluctuations in x-ray or EUV flux are effectively reduced.

Hence, since the absolute positional fluctuations are the same for the primary and the secondary targets, the relative positional fluctuations for the secondary target are drastically reduced, due to its increased size.

The present invention provides improved stability in the radiation flux from the plasma, both in terms of pulse-to-pulse fluctuations and in long-term stability. Furthermore, the present invention provides an increased uniformity in the achieved radiation flux.

Preferably, the beam waist size and shape of the pre-pulse and the main pulse are equal. This is particularly attractive since the same focusing optics may be used for both pulses. However, many different choices of both beam waist sizes and time separation between pre-pulse and main pulse are conceivable within the scope presented by the appended claims.

Among the advantages of the method according to the present invention is a possibility to direct the energy pulse onto the target far away from the nozzle without causing large fluctuations in the radiation flux of the generated X-ray or EUV radiation.

In general, regardless of whether the distance from the plasma to the nozzle is increased, a striking increase in the flux stability is achieved by the inventive method.

Hence, in one aspect, the present invention provides a method for producing X-ray of EUV radiation by energy beam produced plasma emission, in which fluctuations in radiation flux is considerably reduced. In the preferred embodiment, the energy beam is a laser beam.

In another aspect, the present invention provides a method for producing X-ray or EUV radiation, in which a plasma may be formed further away from a target-generating nozzle than what has been appropriate in the prior art, without lowering the flux stability or uniformity.

Also, according to the present invention, a method for producing X-ray or EUV radiation is provided, in which a laser of comparatively poor beam quality can be used as the plasma-producing energy source. This is allowed since any focal spots used are considerably larger than what has been used in the prior art. For some commercially available lasers, the beam quality is simply not good enough to be focused to a small spot.

In this application, where the size of a beam waist is mentioned, it is the full width at half maximum (FWHM) that is referred to.

BRIEF DESCRIPTION OF THE DRAWINGS

Further aspects and advantages of the invention will become apparent when the following detailed description of some preferred embodiments is read. In the detailed description, reference is made to the accompanying drawings, on which.

DETAILED DESCRIPTION OF PREFERRED EMBODIMENTS

Figure 1:
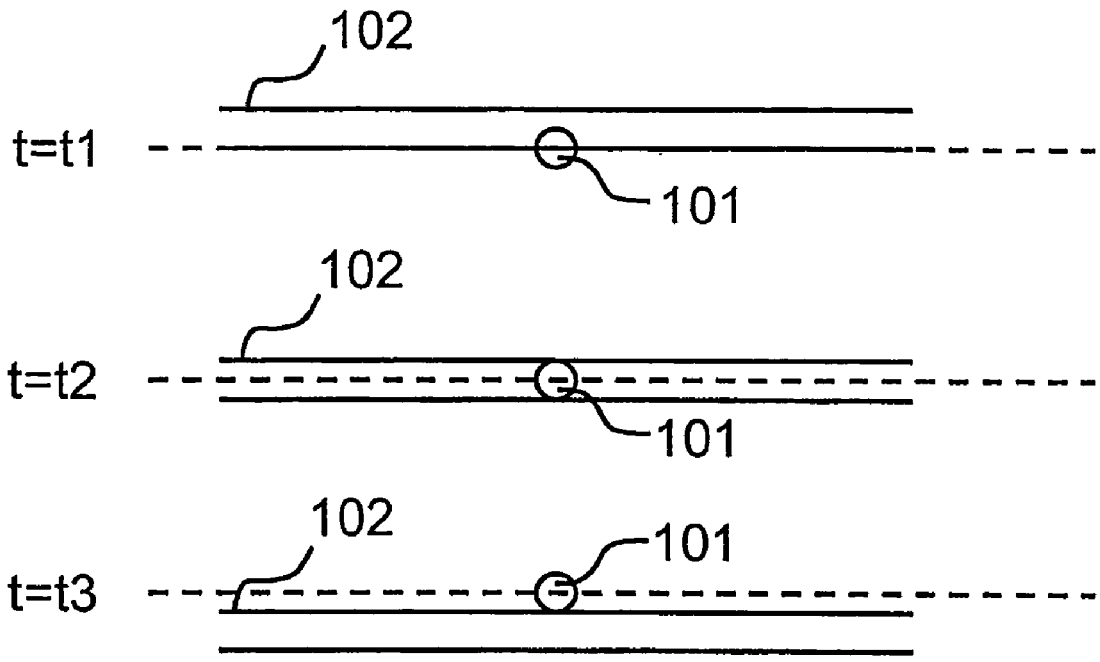
Fig. 1 (PRIOR ART)
FIG. 1 schematically shows the problem of positional fluctuations of the target relative to the energy beam as encountered in the prior art.

Referring now to FIG. 1 of the accompanying drawings, the stability problem encountered in the prior art will be briefly discussed. Typically, in the field of laser produced plasma emission, the laser focus 101 has an ideally fixed position in space. However, even in good laser systems, there might be beam pointing stability issues that cause, or add to, relative positional fluctuations between the target 102 and the laser beam 101. Any perturbation of the target position or the laser beam will therefore cause the laser pulses to partially or entirely miss the target 102. As schematically shown in FIG. 1, the laser pulse 101 is ideally centered at the same position (shown in the figure by a broken line). At time $t_1$ the position of the target may have moved such that the: laser pulse 101 only partially hits the target 102; at time $t_2$ the position of the target 102 may actually be appropriate; and at time $t_3$ the position of the target 102 may be such that the laser pulse 101 misses the target entirely. Such positional fluctuations of the target leads to lowered pulse-to-pulse stability of position, flux and spatial distribution of the radiation emitted from the produced plasma, as well as lowered long-term stability.

Figure 2:
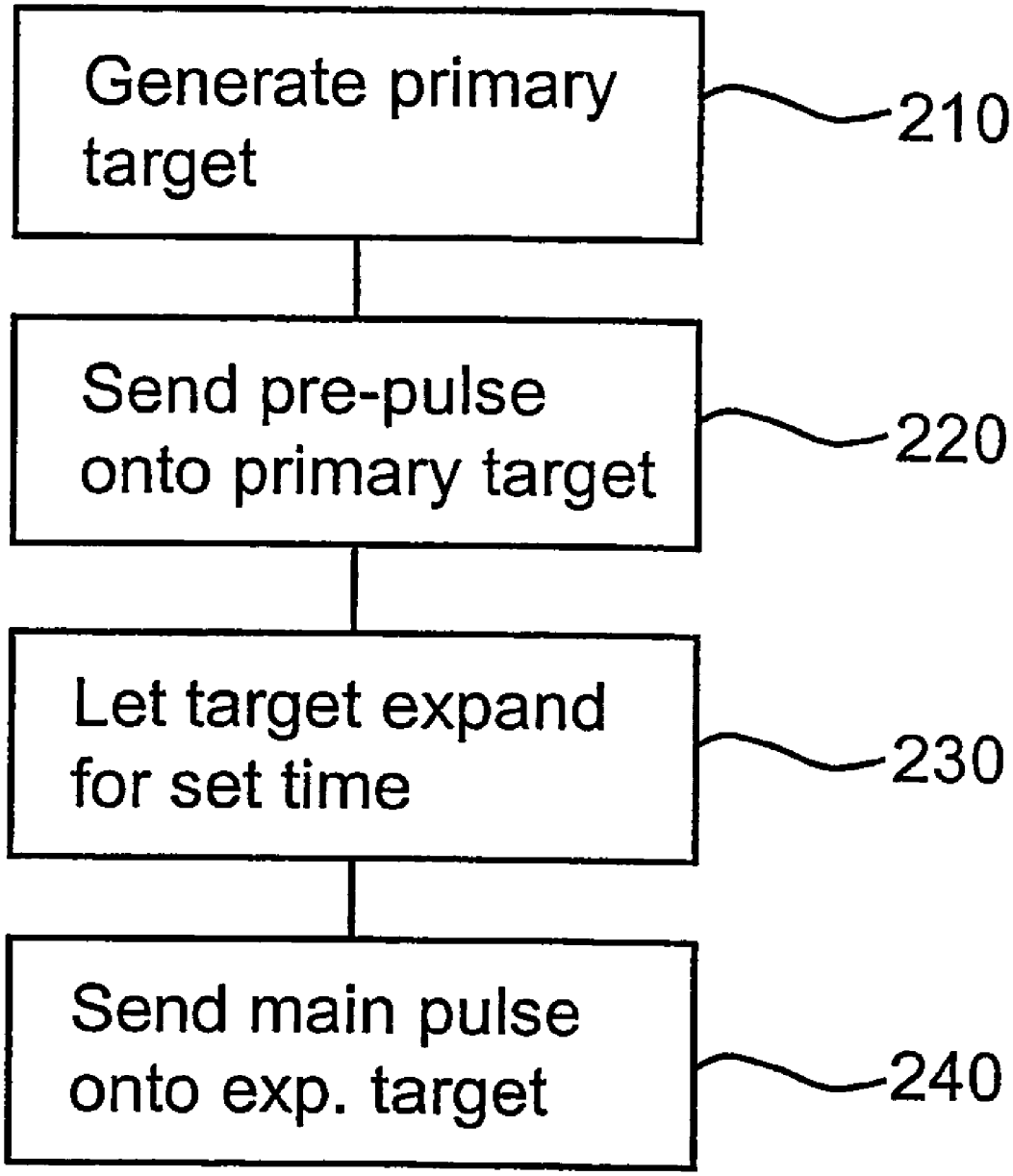
FIG. 2 is a schematic chart outlining the method steps according to the present invention.

To overcome this problem, the present invention provides a method in which an expanded pre-pulse of energy is utilized in order to produce a secondary target, upon which a main energy pulse is directed to produce the radiating plasma. As schematically illustrated in FIG. 2, the method according to the invention comprises the steps of 210 generating a primary target by urging a liquid under pressure through a nozzle; 220 directing a pre-pulse of energy on the target to form a secondary target in the form of a gas or plasma cloud; 230 allowing the secondary target to expand for a predetermined period of time; and 240 sending a main energy pulse on the secondary target to produce the radiating plasma. According to the invention, the pre-pulse of energy has a beam waist size that is larger, in at least one dimension, than the corresponding size of the primary target, whereby influence from the above-mentioned primary target positional fluctuations relative to the energy beam, in said at least one dimension, on the stability of the radiation emitted by the plasma is reduced. Preferably, as mentioned above, the energy pulses are laser pulses.

Figure 3:
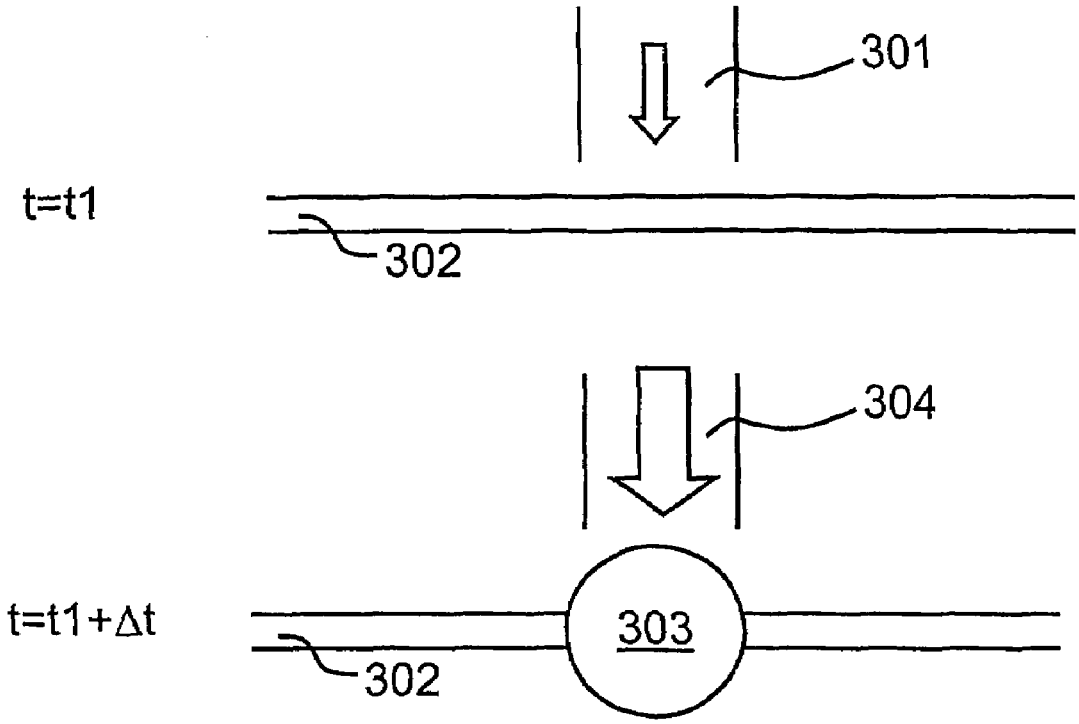
FIG. 3 schematically illustrates an implementation of the invention when a cylindrical target is used.

Reference is now made to FIG. 3. In a preferred embodiment of the present invention, xenon (Xe) is used as the target material. The Xe is cooled to a liquid state and kept in a pressurized container (not shown) at about 20 bar. From the container, the Xe is urged through an outlet orifice, or nozzle, (not shown) to form a jet 302 in an evacuated chamber. The evacuated chamber has a base pressure of about $10^{-8}$ mbar. The diameter of the nozzle in the preferred embodiment is 20 μm, thus producing the jet 302 with a similar diameter. Typically, when Xe is used as the target material, the jet thus formed will freeze to a solid state due to evaporation in the evacuated chamber before any laser pulse is directed thereon. Evaporation of target material gives a xenon partial pressure in the evacuated chamber of about $10^{-3}$ mbar.

However, the target may consist of other substances, and may be kept at liquid state. The target may also be separated into a train of droplets, which may be frozen or liquid. Furthermore, the container for the target material, the nozzle, and any control means may be adapted to deliver droplets on demand into the evacuated chamber.

Hence, the generated Xe jet may have a diameter of about 20 μm and propagate at a speed of about 30 m/s. About 50 mm from the nozzle, the radiating plasma is to be formed. The steps towards producing a radiating plasma start by first directing a laser pre-pulse 301 at time $t_1$ having a beam waist size of about 250 μm onto the target 302. The pre-pulse 301 cause a gas or plasma cloud to form. During a time period Δt of about 100 ns, this cloud is allowed to expand, to form the secondary target 303 for the main laser pulse 304. After said time period has elapsed, at the time $t_1+\Delta t$, the main laser pulse 304 is directed onto the secondary target 303 in order to form a highly ionized, radiating plasma, which is the actual source for the X-ray or EUV radiation.

The pulse-to-pulse and long-term stability of position, flux and spatial distribution of the emitted radiation is further-increased by making the main laser pulse 304 slightly smaller than the size of the expanded secondary target 303. More particularly, the main pulse 304 should have a sufficiently small cross section to fall within the extension of the secondary target 303, subject to expected variations in the position of the secondary target. By further adjusting the pulse energy and pulse length for the main pulse 304, this increased stability can be obtained with a maintained high conversion efficiency of energy into X-ray or EUV radiation.

As briefly mentioned in the summary above, when using the same beam waist size for both the pre-pulse 301 and the main laser pulse 304, an optical system common to both the laser pulses can be employed. This is taken advantage of in the preferred embodiment.

The same laser could in principle be used for both the pre-pulse and the main pulse. However, a delay of 100 ns, as in the preferred embodiment, corresponds to an optical path length difference of about 30 m. Therefore, for the pre-pulse and the main pulse, respectively. In the preferred embodiment, two Nd:YAG lasers emitting light at 1064 nm are used. However, other lasers are also possible, having other pulse lengths, wavelengths, pulse energies etc. The lasers are Q-switched in order to deliver energetic, 5 ns long pulses at a repetition rate of 20 Hz. The light constituting the main pulse 304 is delayed 100 ns relative to the light constituting the pre-pulse 301. The energy of the pre-pulse is about 10 mJ, while the energy in the main pulse is about 200 mJ. In the preferred embodiment, the pre-pulse and the main pulse both have the same pulse length equal to 5 ns.

The expansion of the secondary target 303 produced by the laser pre-pulse 301 (the first energy pulse) is primarily driven by thermal energy. Because Xe atoms are relatively heavy, the rate of expansion is rather slow. Therefore, the time Δt between the first laser pulse 301 and the second, main laser pulse 304 must be long enough for allowing the gas or plasma cloud 303 to expand appropriately. For a target material of lower atomic mass, the time period Δt between the first and the second laser pulse should be shorter. Also, the higher the energy in the pre-pulse 301, the faster the rate of expansion of the cloud (due to a higher temperature). Therefore, the period of time between the pre-pulse and the main pulse should be set according to the target material used and the energy of the pre-pulse, with a view to achieve a secondary target cloud of appropriate size and density for the main laser pulse. The appropriate settings for each situation will be found by the skilled person after having read and understood this specification.

Figure 5:
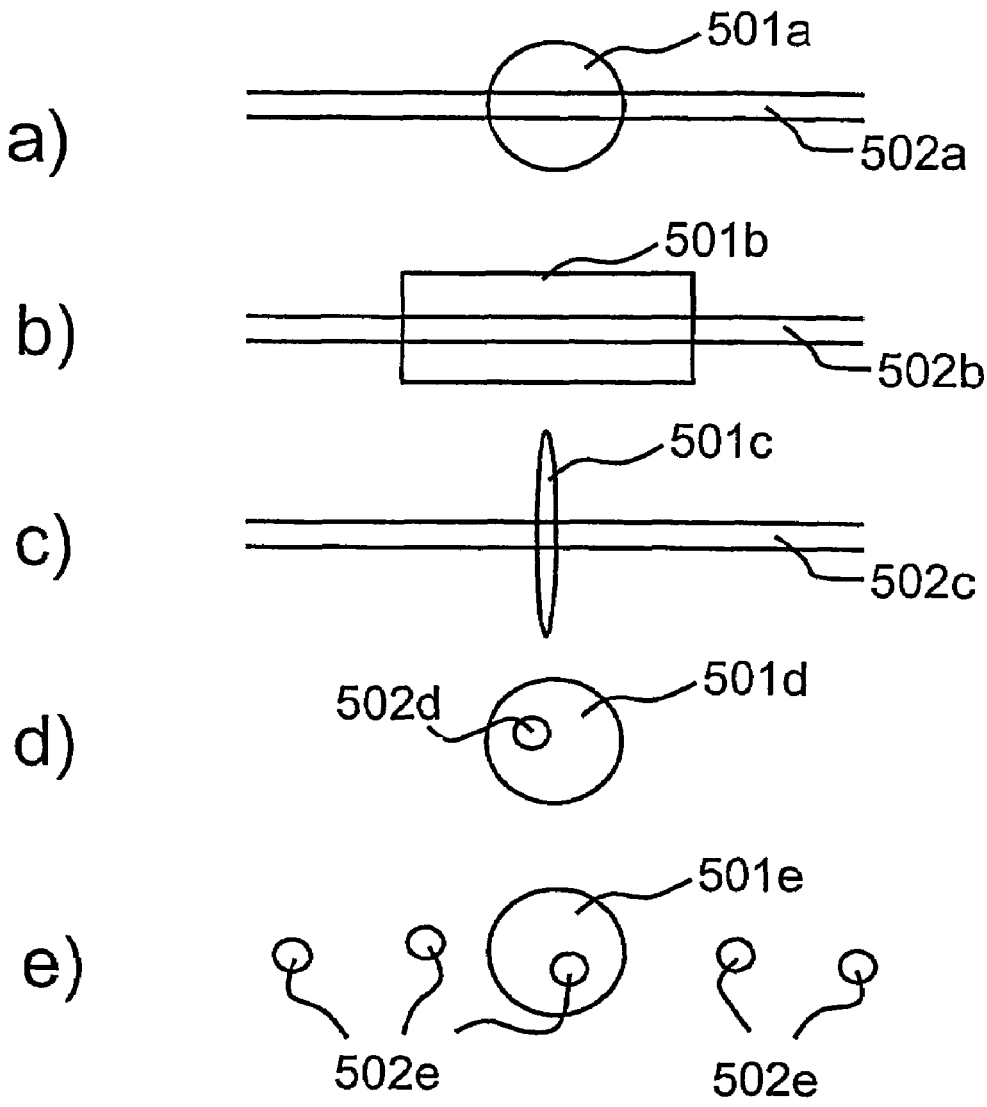
FIG. 5*a–e* schematically shows different combinations of pre-pulse and target.

Since the primary target 302 in the preferred implementation is a cylindrical jet, there is only a risk of not hitting the target with the pre-pulse 301 in the transverse dimension with respect to the propagation direction of the jet 302. Therefore, it might be preferred to use a line focus for the pre-pulse, having an elongated extension transverse to the jet. This is schematically shown in FIG. 5*c*. Hence, depending on the geometry of the primary target, it may be sufficient for the pre-pulse to be larger than the primary target in only one dimension.

Figure 4:
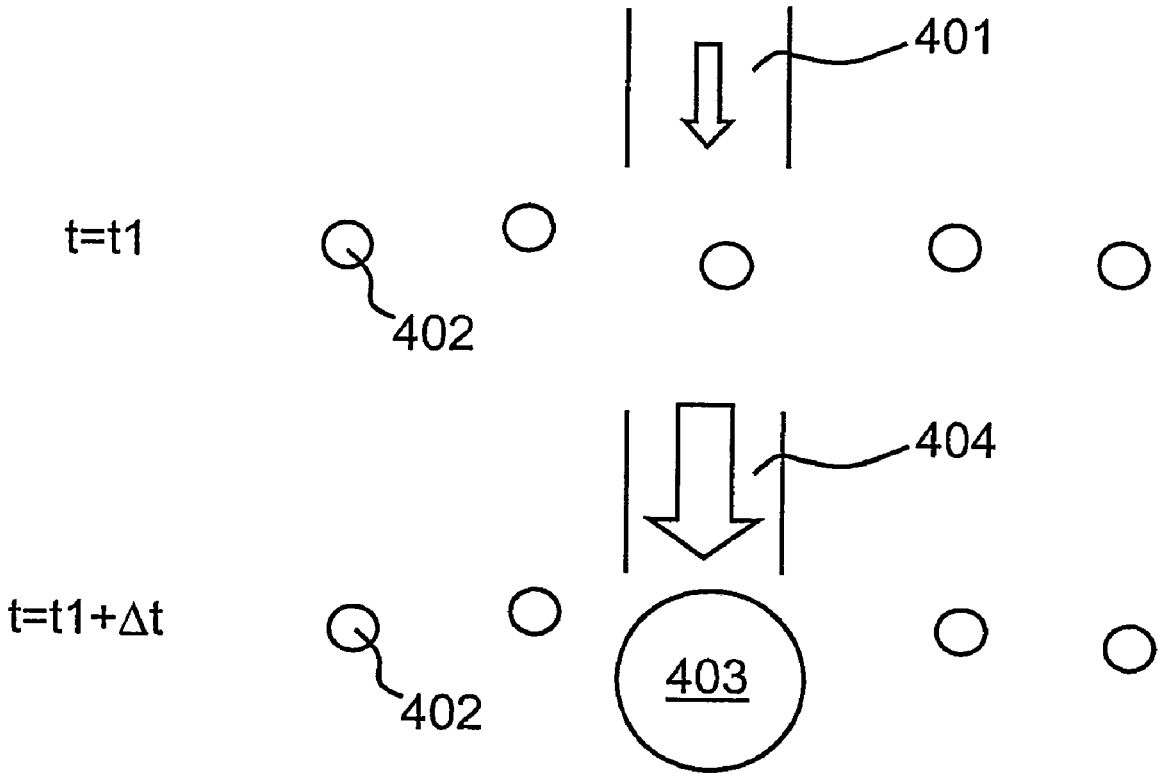
FIG. 4 schematically illustrates an implementation of the invention when a droplet target is used.

FIG. 4 schematically shows a similar implementation to that shown in FIG. 3. In FIG. 4, however, droplets 402 are used as the primary target, rather than a cylindrical jet of target material. In this case, there is also a potential risk of not hitting the primary target 402 in the longitudinal dimension (the propagation direction of the droplet). Therefore, in this case, a pre-pulse 401 having a circular beam waist cross section is preferably used. Any jitter in the timing of the target droplets 402 arrival at the position where the laser pulse 401 is directed onto the target will lead to primary target positional fluctuations or uncertainties. Again, by using a pre-pulse 401 that is larger than the target, any influence from such fluctuations on the radiation flux stability is reduced.

Although the most preferred embodiment employs rotationally symmetric focal spots 501*a* (FIG. 5*a*), other embodiments have made use of extended focal shapes, such as line focuses 501*b*, 501*c* (FIG. 5*b*, 5*c*). FIG. 5*b* shows a situation where a line focus 501*b* coextending with the cylindrical target 502*b* is used, and FIG. 5*c* shows a situation where a line focus 501*c* transverse to the cylindrical target 502*c* is used. In all other aspects, the features of the embodiment with line focuses are similar to those of the embodiment with round focal spots described above. When using a primary target consisting of a droplet 502*d* or *a* train of droplets 502*e*, a circular pre-pulse 501*d*, 501*e* is preferably used (FIGS. 5*d* and 5*e*). In general, any type of focus for the energy beam (laser beam) can be used when implementing the present invention, as long as the laser beam focus is larger than the target in at least one dimension (viz. the dimension in which influence from positional fluctuations is to be reduced).

Figure 6:
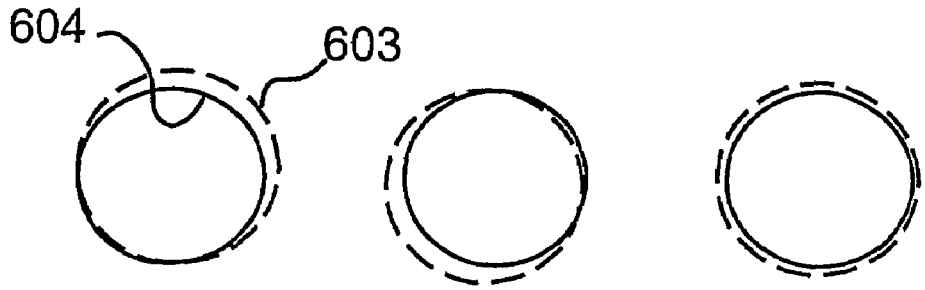
FIG. 6 schematically shows the matching of main energy pulse to secondary target.

In FIG. 6, the matching of the main energy pulse to the secondary target is illustrated. The expanded secondary target is shown by broken lines 603, and the beam waist of the main energy pulse at the secondary target is shown by solid lines 604. Although the relative position of the expanded secondary target 603 varies only slightly, there is still some uncertainty regarding the position of the secondary target at the time the main energy pulse 604 is directed thereon. For this reason, the main energy pulse 604 preferably has a beam waist that is slightly smaller than the expanded secondary target 603. If the position of the secondary target 603 is changed by a small amount from pulse to pulse, the entire main pulse 604 still hits target material, leading to an increased stability.

The present invention has been described above with reference to some preferred embodiments. However, it is apparent to the skilled person that variations and modifications are conceivable within the scope of the invention as defined in the appended claims.

For example, the diameter of the nozzle producing the primary target may have other dimensions than what has been disclosed herein. It is to be understood that the absolute magnitude of the diameter of the primary target is of minor relevance for the purposes of the present invention. In addition, the primary target may be a semi-continuous jet or a frozen jet that has broken up into fragments.

Moreover, the pressure inside the container for the target material, which is set to about 20 bar in the preferred embodiment, may be from below 10 bar to far above 100 bar. Again, this is a parameter that has minor relevance for the principles of the present invention.

Furthermore, the invention has been described with reference to Xe as the target material. However, the teachings of the present invention may be applied also to other target materials, such as other noble gases (cooled to a liquid state); various compounds and mixtures; liquid metals, such as tin; as well as various kinds of organic liquids, such as ethanol.

In addition, it is of course possible within the scope of the invention to use a plurality of first and second energy pulses, which are simultaneously directed onto the target.

CONCLUSION

In conclusion, a method of producing a radiating plasma with an increased flux stability and uniformity has been disclosed. The method comprises the steps of generating a primary target by urging a liquid under pressure through a nozzle; directing an energy pre-pulse onto the primary target to generate a secondary target in the form of a gas or plasma cloud; allowing the thus formed gas or plasma cloud to expand for a predetermined period of time; and directing a main energy pulse onto the gas or plasma cloud when the predetermined period of time has elapsed in order to produce a plasma radiating X-ray or EUV radiation. The pre-pulse has a beam waist size that is larger, in at least one dimension, than the corresponding dimension of the primary target, whereby influence from primary target positional fluctuations, in said at least one dimension, on the radiation flux stability is reduced.

The invention claimed is:

1. A method for producing X-ray or EUV radiation by emission from an energy beam produced plasma, comprising the steps of:

generating a primary target by urging a liquid under pressure through a nozzle;

directing a first energy pulse onto said primary target to generate a secondary target;

allowing the secondary target to expand for a predetermined period of time;

directing a second energy pulse onto said secondary target when said predetermined period of time has elapsed, the second energy pulse having an energy that is higher than the energy of the first energy pulse, in order to produce a plasma that emits the X-ray or EUV radiation;

wherein the first energy pulse has a beam waist size at the primary target that is larger, in at least one dimension, than the corresponding size of said primary target, and wherein influence from primary target positional fluctuations, in said at least one dimension, on the stability of the radiation emitted by the plasma is reduced; and wherein the second energy pulse has a beam waist size that is smaller than the corresponding size of the secondary target at the time when the second energy pulse is directed onto said secondary target.

2. A method as claimed in claim 1, wherein beam waist size and shape of the first energy pulse is substantially equal to that of the second energy pulse.

3. A method as claimed in claim 2, wherein at least one of the energy pulses is a laser pulse.

4. A method as claimed in claim 1, wherein the predetermined period of time between the first and the second energy pulse is in the range from 20 ns to 500 ns.

5. A method as claimed in claim 1, wherein at least one of the energy pulses is a laser pulse.

6. A method as claimed in claim 1, wherein the primary target is a cylindrical jet or droplets having a diameter of about 20 μm, and the beam waists of both the first and second energy pulses are round and have a diameter of about 250 μm when focused onto the primary target and the secondary target, respectively.

7. A method as claimed in claim 1, wherein the first and the second energy pubes are directed onto the primary target and the secondary target, respectively, at a distance of more than 10 mm from the nozzle.

8. A method as claimed in claim 1, wherein the primary target is a spatially continuous or semi-continuouse jet.

9. A method as claimed in claim 1, wherein the primary target is a droplet.

10. A method as claimed in claim 8, wherein the primary target is in a frozen state at the point where the first energy pulse is directed onto said primary target.

11. A method as claimed in claim 1, wherein the target material is Xe.

12. A method as claimed in claim 1, wherein the energy in the first energy pulse is between 1% and 10% of the energy in the second energy pulse.

13. A method as claimed in claim 1, wherein the pulse length of both the first energy pulse and the second energy pulse is about 5 ns.

14. A method as claimed in claim 1, wherein the beam waist size of the first energy pulse is between 2 and 20 times larger than the smallest dimension of the primary target.

15. A method as claimed in claim 1, wherein the produced radiation is utilized in connection with EUV lithography.

16. A method as claimed in claim 15, wherein the produced radiation is utilized in a EUV lithography stepper apparatus.

17. A method as claimed in claim 15, wherein the produced radiation is utilized in EUV metrology or in an inspection apparatus.

18. A method as claimed in claim 1, further comprising the step of performing X-ray microscopy with the produced radiation.

19. A method as claimed in claim 1, further comprising the step of performing X-ray fluorescence with the produced radiation.

20. A method as claimed in claim 1, further comprising the step of performing X-ray diffraction with the produced radiation.

* * * * *